United States Patent [19]

Idota

[11] Patent Number: 4,912,015

[45] Date of Patent: Mar. 27, 1990

[54] SILVER SALT DIFFUSION TRANSFER USING ORGANIC PHOSPHONIC ACID COMPOUNDS

[75] Inventor: Yoshio Idota, Kanagawa, Japan

[73] Assignee: Fuji Photo Film Co., Ltd., Kanagawa, Japan

[21] Appl. No.: 245,191

[22] Filed: Sep. 16, 1988

[30] Foreign Application Priority Data

Sep. 16, 1987 [JP] Japan ..... 62-231372

[51] Int. Cl.[4] ..... G03C 5/54

[52] U.S. Cl. ..... 430/248; 430/233; 430/251; 430/491; 430/610

[58] Field of Search ..... 430/233, 248, 249, 251, 430/491, 610

[56] References Cited

U.S. PATENT DOCUMENTS 3,201,246 8/1965 Allen et al. ..... 430/491
3,488,707 1/1970 Willems et al. ..... 430/610
3,994,730 11/1976 Frank et al. ..... 430/491
4,689,287 8/1987 Katoh et al. ..... 430/233

FOREIGN PATENT DOCUMENTS 895960 5/1962 United Kingdom ..... 430/248

*Primary Examiner*—Richard L. Schilling
*Attorney, Agent, or Firm*—Sughrue, Mion, Zinn, Macpeak & Seas

[57] ABSTRACT

A method of forming an image by silver salt diffusion transfer comprising (a) developing a light-sensitive element including an imagewise exposed light-sensitive silver halide emulsion layer with an alkali processing solution comprising a silver halide solvent to convert at least a portion of unexposed silver halide in the emulsion layer into a transferable silver complex salt, and (b) transferring at least a portion of the silver complex salt to an image-receiving element containing a silver precipitating agent to form an image on the image-receiving layer, wherein the processing is carried out in the presence of an organic phosphonic acid compound.

15 Claims, No Drawings

SILVER SALT DIFFUSION TRANSFER USING ORGANIC PHOSPHONIC ACID COMPOUNDS

FIELD OF THE INVENTION

The present invention relates to a method of forming images by silver salt diffusion transfer and a film unit for use thereon.

BACKGROUND OF THE INVENTION

A method of forming images by diffusion transfer using silver salts such as silver halide is well known. In accordance with this method, an imagewise exposed light-sensitive silver halide emulsion is first treated with an aqueous alkali solution containing a developing agent, a silver halide solvent and a film-forming agent (tackifier) to reduce the exposed silver halide grains to silver with the developing agent while unexposed silver halide grains are converted into a transferable silver complex salt by the silver halide solvent. The silver complex salt is then transferred by diffusion to a silver precipitating agent-containing layer (image-receiving layer) superimposed on the above emulsion layer by imbibition, and the silver complex salt is reduced by the developing agent and the silver precipitating agent to obtain a silver image.

In the practice of the above method, there is used, for example, a film unit comprising a light-sensitive element comprising a support and a light-sensitive silver halide emulsion layer provided thereon; an image-receiving element comprising a support and an image-receiving layer containing a silver-precipitating agent provided on the support, and a processing element comprising ruptuable containers accomodating an active aqueous alkali solution containing a silver halide solvent, a developing agent and a film-forming agent. In the first step, the emulsion layer of the light-sensitive element is exposed imagewise, and then the light-sensitive element and the image-receiving element are superimposed in such a manner that the emulsion layer and the image-receiving layer of the image-receiving element face each other, and are then passed between a pair of rolls so that the processing element is broken and the viscous aqueous alkali solution is spread between the two elements. The superimposed and alkali treated elements are allowed to stand for a predetermined time and the image-receiving element is peeled apart from the light-sensitive element whereupon the desired image is formed on the image-receiving layer.

If, however, the image formed by the diffusion transfer method is stored for a long time, discoloration or fading of the image will occur. This discoloration or fading is undesirable for a recording material.

SUMMARY OF THE INVENTION

An object of the present invention is to provide a method of forming images by silver salt diffusion transfer.

Another object of the present invention is to reduce discoloration or fading due to the long term storage of images.

It has been found that the above objects are attained by a method of forming an image by silver salt diffusion transfer, including the steps of (a) developing a light-sensitive element containing an imagewise exposed light-sensitive silver halide emulsion layer with an alkali processing composition in the presence of a silver halide solvent to convert at least a portion of unexposed silver halide of the emulsion layer into a transferable silver complex slat, and (b) transferring at least a portion of the complex salt to a silver precipitating agent-containing image-receiving layer to form an image on the image-receiving layer, wherein the processing is carried out in the presence of an organic phosphonic acid compound.

DETAILED DESCRIPTION OF THE INVENTION

Organic phosphonic acids represented by the general formulae (I), (II) or (III) as shown below are preferably used.

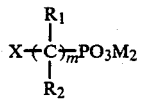

(I)

wherein X is an alkyl group, a substituted alkyl group (preferably the number of carbon atoms of the alkyl portion is from 1 to 5),

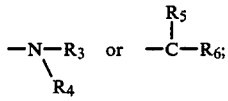

wherein $R_3$ to $R_6$, which may be the same or different, each is a hydrogen atom or a lower alkyl group (preferably having 1 to 3 carbon atoms); $R_1$ and $R_2$, which may be the same or different, each is $—PO_3M_2$, —COOM, —OH, $—R_7PO_3M_2$, $—R_8(COOM)_n$ or $—R_9OH$; $R_7$ to $R_9$, which may be the same or different, each is an alkylene group (preferably having 1 to 3 carbon atoms); and m and n represent an integer from 1 to 3 and M represents H, Na or K.

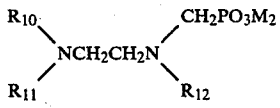

(II)

wherein $R_{10}$ to $R_{12}$, which may be the same or different, each is $—CH_2PO_3M_2$ or $—CH_2COOM_2$ wherein M represents H, Na or K.

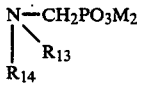

(III)

wherein $R_{13}$ and $R_{14}$, which may be the same or different, each is $—CH_2PO_3M_2$, $—CH_2COOM_2$ or a lower alkyl group (preferably having 1 to 4 carbon atoms), and M is H, Na or K.

The total amount of the compounds of the general formulae (I) to (III) used in the present invention is generally from $5\times10^{-4}$ to 1 mol, preferably from $1\times10^{-3}$ to $5\times10^{-1}$ mol and more preferably from $1\times10^{-2}$ to $4\times10^{-1}$ mol per kilogram of the processing composition.

The total amount of the compounds of the general formulae (I) to (III) used in the light-sensitive element is preferably from $2\times10^{-5}$ to $1\times10^{-2}$ mol/m$^2$, and more preferably from $2\times10^{-4}$ to $5\times10^{-3}$ mol/m$^2$.

The total amount of the compounds of the general formulae (I) to (III) used in the image-receiving element is generally from $1\times10^{-5}$ to $5\times10^{-2}$ mol/m$^2$, and preferably from $1\times10^{-4}$ to $1\times10^{-2}$ mol/m$^2$.

The compounds of the general formulae (I) to (III) are effective for purposes of the present invention when contained in any of the processing composition, the light-sensitive element and the image-receiving element. It is particularly advantageous, however, that they are contained in the processing composition.

Preferred compounds among the compounds of the general formulae (I) to (III) are shown below although the present invention is not limited thereto.

1.
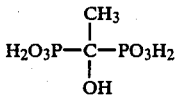

2.
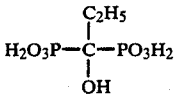

3.
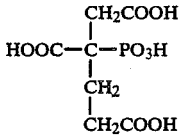

4.
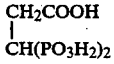

5.
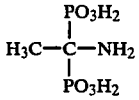

6.
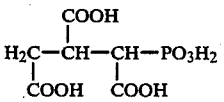

7.
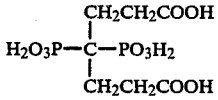

8.
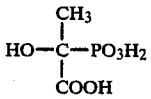

9.
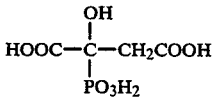

10.
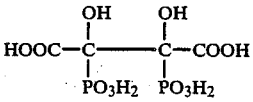

11.
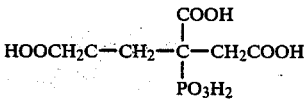

12.
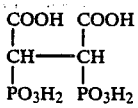

-continued

13.
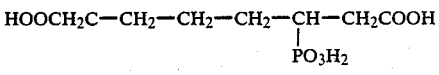

14.
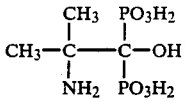

15.
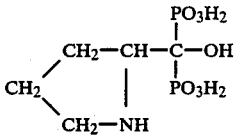

16.
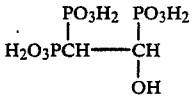

17.
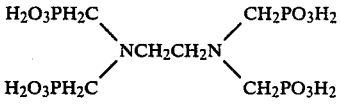

18.
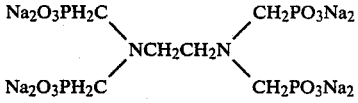

19.
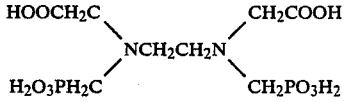

20.
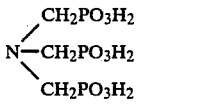

21.
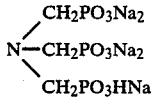

22.
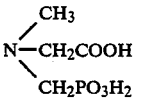

23.
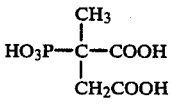

24.
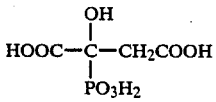

25.
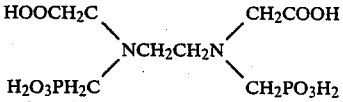

26.
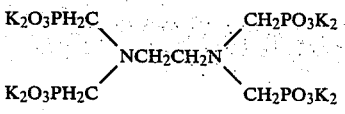

In general, as a means of improving storage properties of an image, it is effective to use mercapto compounds or noble metal salts to protect the surface of a silver image. As a method of lowering the chemical activity of the processing composition by lowering the pH of a print, it is effective to use acidic polymers in order to provide a neutralization capability. Moreover, as a method of decreasing the absorption of the processing composition which is responsible for discoloration, it is effective to increase the thickness of the hydrophobic layer.

However, it has not been known that organic phosphonic acid compounds of the present invention are effective in improving the storage properties of images, particularly silver image areas obtained by the diffusion transfer method.

Based on the knowledge that a metal ion or a metal can act as a catalyst increasing the rate of oxidation of an oxidizaing agent (e.g., oxygen, hydrogen peroxide, the oxidized product of a developing agent) which is responsible for deterioration of silver images, it was hypothesized that decreasing the activity of the catalyst would effectively improve the storage properties of the silver image. Means to decrease the activity of the catalyst were therefore investigated.

As one of the means to decrease the catalytic activity, the addition of metal chelating agents was investigated. This investigation, however, showed that ethylenediamine tetraacetic acid, which is a typical example of a metal chelating agent, accelerated the deterioration of the image contrary to expectations. Further investigations of various aminopolycarboxylic acids and organic phosphonic acids showed that the aminopolycarboxylic acids were ineffective or even accelerated the deterioration, while all of the organic phosphonic acids inhibited deterioration.

It is believed, therefore, that the organic phosphonic acids decrease the catalyst acitivity of metal, although the present inventors do not wish to be bound by this statement. Upon this belief, it is considered that if water or a solvent from which metals ions have been removed to a high level is used, the deterioration of the image is inhibited. In practice, however, the use of the organic phosphonic acid is advantageous from an economic standpoint.

The compounds of general formulae (I) to (III) used in the present invention and methods for preparation thereof are described in JP-A-59-184341, 59-160142, 53-84920, 52-102726, 50-95227, 46-3812, 46-81337, 49-49887, 54-121127, 53-82725, 55-4024, 57-179843, 53-42730, 55-65956, 55-126241, 55-4025, 55-65955, 56-97347, 54-61125, 55-29883 (the term "JP-A" as used herein means an "unexamined Japanese patent application"); U.S. Pat. Nos. 3,201,246, 3,647,449, 3,994,730, and Research Disclosure Nos. 13410 and 18170.

In the image-forming method and the film unit of the present invention, the developing agent may be present in the light-sensitive element or the processing composition. Preferably the developing agent is contained in the processing composition. As the developing agent, for example, hydroquinone, tert-butylhydroquinone, benzene, naphthalene and naphthalene desivatives having a hydroxyl group at the para-or ortho-position can be used.

Reductic acid as described in U.S. Pat. No. 3,615,440 and $\alpha$, $\beta$-ethanediol as described in U.S. Pat. No. 3,730,716 are preferred. Hydroxylamine developing agents as described in U.S. Pat. Nos. 3,287,125 and 3,293,034 are more preferred.

The amount of the developing agent used is preferably from 0.1 to 40 g, most preferably 1 to 20 g per 100 g of the processing composition.

1-Aryl-3-pyrazolidinone compounds and alkyl-substituted p-aminophenols which are described as developing agents in JP-B-49-13580 may be used in combination with the above developing agents (the term "JP-B" as used herein means an "examined Japanese patent publication").

The silver halide solvent may be present in the processing element, the light-sensitive element and/or the image-receiving element. It is preferred for the silver halide solvent to be present in the processing composition. Cyclic compounds described in U.S. Pat. Nos. 2,857,274, 2,857,275 and 2,857,276 are suitable. Of these, uracyl, urazole, 6-methyluracyl and the like are preferred.

Alkali metal thiosulfuric acid salts, particularly sodium or potassium salts are also preferred silver halide solvents. In addition, disulfonyl-methane compounds as described in U.S. Pat. Nos. 3,958,992, 3,976,647, 4,009,167, 4,032,538, 4,046,568, 4,047,954, 4,047,955, 4,107,176 and JP-A-47-330; dihydroxypyrimidine compounds containing a thioether group as described in U.S. Pat. Nos. 4,126,459, 4,150,228, 4,211,559 and 4,211,562, and aminothio ethers as described in U.S. Pat. Nos. 4,251,617, 4,267,254 and 4,267,256 can be used. These compounds can be used alone or in combination with one another. When two or more cyclic imide compounds or dihydroxypyrimidine compounds containing a thioether group are used in combination, the precipitation of white crystals on the surface of the print does not occur even if the resulting print is stored for a long period of time.

The amount of the silver halide solvent added is preferably from 0.1 to 30 g, more preferably from 0.5 to 10 g per 100 g of the alkaline processing composition.

When the processing solution (processing composition) of the present invention is applied in a thin layer form between the light-sensitive element and the image-receiving element superimposed on each other, it is preferred that the processing solution also contains a polymeric film-forming agent, a thickening agent or a tackifier, Hydroxyethyl cellulose and sodium carboxymethyl cellulose are particularly useful for these purposes and are incorporated in the processing solution in an effective concentration to provide suitable viscosity. The processing solution may further contain other known additives such ad an antifoggant, a toning agent, a stabilizer and the like. In particular, incorporation of an oxyethylamino compound, for example, tri-ethanolamine as described in U.S. Pat. No. 3,619,185, can increase the storage life of the processing solution.

The aforementioned processing solution is preferably incorporated in a rupturable container to form the processing element. The material of the rupturable container is not critical; known materials such as those are described in U.S. Pat. Nos. 3,056,491, 3,056,492, 3,173,580, 3,750,907, 3,833,381, 4,303,750 and 4,303,751.

The image-receiving element of the present invention comprises a support such as a baryta paper, cellulose triacetate film or a polyester film, having coated thereon an image-receiving layer containing a silver-precipitating agent. This image-receiving element can be produced by first coating a support, if necessary, having a subbing layer provided thereon, with a coating solution comprising a cellulose ester such as cellulose diacetate with a silver precipitating agent dispersed therein. Then, by subjecting the cellulose ester layer thus obtained to alkali hydrolysis, the cellulose ester is at least partially converted into cellulose in the depth direction. In a particularly useful embodiment, the silver precipitated layer and/or the underlying unhydrolyzed cellulose ester, for example, unhydrolyzed areas of the cellulose diacetate-containing cellulose ester layer contains an effective amount one or more mercapto compounds suitable for improving the one or more of the color tone of a silver transferred image, its stability or other photographic properties. The mercapto compound is deffused from the position at which it was first placed, during imbibition and utilized. An image-receiving element of this type is described in U.S. Pat. No. 3,607,269.

Preferred examples of the mercapto compound are described in JP-B-56-44418, JP-A-49-120634, British Patent Nos. 1,276,961, JP-B-56-21140, and JP-A-59-231537 and JP-A-60-122939.

Specific examples of the silver precipitating agent include heavy metals such as iron, lead, zinc, nickel, cadmium, tin, chromium, copper, cobalt, and particularly noble metals such as gold, silver, platinum and palladium. Other useful silver precipitating agents are the sulfides and sellenides of noble metals, more specifically the sulfides of mercury, copper, aluminum, zinc, cadmium, cobalt, nickel, silver, lead, antimony, bismuth, cerium, magnesium, gold, platinum and palladium, and the selenides of lead, zinc, antimony and nickel.

Gold, platinum, palladium and their sulfides are particularly preferred.

It is preferred that an acidic polymer layer for neutralization (alkali neutralizing layer) be provided between an unsaponified layer (timing layer) and a support.

In the alkali neutralizing layer to be used in the present invention, for example, polymeric acids and the like as described in JP-B-48-33697 are used. Preferred polymeric acids include maleic anhydride copolymers such as a styrene-maleic anhydride copolymer, a methyl vinyl ether-maleic anhydride copolymer and an ethylene-maleic anhydride copolymer, and (meth)acrylic acid polymers or copolymers such as an acrylic acid-alkyl acrylate copolymer, an acrylic acid-alkyl methacrylate copolymer, a methacrylic acid-alkyl acrylate copolymer, and a methacrylic acid-alkyl methacrylate copolymer.

In addition, polymers containing a sulfonic acid group such as polystyrenesulfonic acid and an acetalized product of benzaldehydesulfonic acid and polyvinyl alcohol are useful.

The neutralizing layer may also contain a mercapto compound as used in the timing layer. For the purpose of improving the physical properties of the film, the polymeric acids may be used in admixture with hydrolyzable alkali-impermeable polymers (preferably the above cellulose esters) or alkali permeable polymers.

To improve the storage properties of the formed images, it is preferred for the image-receiving sheet to have an image stabilizing layer comprising at least a stabilizer and a binder. As the stabilizer, cationic polymer electrolytes are preferred. Of these, water dispersion latexes as those described in JP-A-59-166940, U.S. Pat. No. 3,958,995 JP-A-55-142339, 54-126027, 54-155835, 53-30328 and 54-92274; polyvinyl pyridium salts as described in U.S. Pat. Nos. 2,548,564, 3,148,061 and 3,756,814; water-soluble quaternary ammonium salt polymers as described in U.S. Pat. No. 3,709,690, and water-insoluble quaternary ammonium salt polymers as described in U.S. Pat. No. 3,898,088 are particularly preferred.

As the binder for the image stabilizing layer, cellulose acetate is preferred, in particular a cellulose acetate having a degree of acetylation of 40 to 49%. It is preferred that the image stabilizing layer be provided between the neutralizing layer and the timing layer.

An intermediate layer can be provided between the image-receiving layer and the said timing layer containing the toning agent and the stabilizer. Preferred materials for the intermediate layer are gum arabic, polyvinyl alcohol, and polyacrylamide.

In order to prevent the processing solution from attaching to the surface of the image-receiving layer at the time of peeling after extension of the processing solution, it is preferred that a peeling layer be provided on the surface of the image-receiving layer. Preferred materials for the peeling layer include gum arabic, hyroxyethyl cellulose, methyl cellulose, polyvinyl alcohol, polyacrylamide and sodium alginate. In addition, compounds as described in U.S. Pat. Nos. 3,772,024, 3,820,999 and British Patent No. 1,360,653 can be used.

A light-sensitive element, containing a light-sensitive silver halide emulsion layer on a support is preferably used in the present invention.

In the light-sensitive silver halide emulsion (hereinafter "light-sensitive emulsion") to be used in the present invention, any of silver bromide, silver iodobromide, silver iodochlorobromide, silver chlorobromide and silver chloride can be used as the silver halide. Silver iodobromide or silver iodochlorobromide containing 10 mol % or less of silver iodide is preferred. Particularly preferred is silver iodobromide containing 3 to 10 mol % of silver iodide.

The mean particle size (particle diameter in the case of spherical or nearly spherical particles, and edge length in the case of cubic particles, all being determined based on projected areas and indicated in terms of the mean value) of silver halide grains in the light-sensitive emulsion is not critical. It is preferably not more than $3\mu$, more preferably not more than $2\mu$ and most preferably from 0.4 to $1.6\mu$.

The particle size distribution may be narrow or broad.

The silver halide grains in the light-sensitive emulsion may have an isometric crystal form such as cubic or octahedral, or an irregular crystal form such as tabular or spherical, or a composite crystal form thereof. A mixture of grains having different crystal forms can also be used.

In the silver halide grains, the inner and the outer layer may be in different phases, or may be in the same phase. The silver halide grains may be such that a latent image is formed mainly on the surface thereof, or that a latent images is formed mainly in the inside thereof. The former silver halide grains is preferred.

The thickness of the light-sensitive emulsion layer is generally from 0.5 to $8.0\mu$, preferably from 0.6 to $6.0\mu$, and the amount of silver halide grains coated is generally from 0.1 to 3 $g/m^2$ and preferably from 0.2 to 1.5 $g/m^2$.

The light-sensitive emulsion can be prepared by any method commonly employed in preparation of the silver halide photographic emulsions. Further, the light-sensitive emulsion can be subjected to chemical sensitization and/or spectral sensitization, if desired. The emulsion may also contain an antifoggant, a stabilizer, a hardening agent, a coating aid, an antistatic agent and the like. In addition, a vehicle such as gelatin can be used in the emulsion.

Light exposure to obtain a photographic image can be carried out using any conventional source such as natural light (sun light), a tungsten lamp, a fluorescent lamp, a mercury lamp, a xenon arc lamp, a carbon arc lamp, a xenon flash lamp, a cathode ray tube frying spot and the like. In connection with the exposure time, exposure for 1/1,000 to 1 second which is commonly employed in the usual cameras, or exposure for less than 1/1,000 second such as exposure for $1/10^4$ to $1/10^6$ seconds using a xenon flash lamp or a cathode ray tube, or exposure for longer than 1 second can be employed. If necessary, a color filter may be used to control the spectral composition of light to be used in exposure. For the light exposure, laser light can also be employed. In addition, light emitted from a fluorescent body excited by electron rays, X-rays, $\gamma$-rays, $\alpha$-rays and the like can be used.

The light-sensitive element, the image-receiving element and the processing element are combined to form a film unit. Arrangement of the elements and a method of combining them are described in, for example, Neblettes, *Handbook of Photography and Reprography,* 7th ed., pp. 282–285. Particularly preferred embodiments are described in U.S. Pat. No. 3,350,991, the desclose of which can be referred to in the present invention.

The present invention can be used in the diffusion transfer method in which an image is formed by the use of an automatic developing machine and wherein the image-receiving element is made up of gelatin.

The present invention can be applied to film types that after extending the processing composition, the image-receiving element and the light-sensitive element are separated from each other, or to one unit types in which the film remains as one unity.

In the present invention, the compounds represented by the general formulae (I) to (III) are incorporated in the processing composition and/or the light-sensitive element and/or the image-receiving element, and discloration or fading due to the long term storage of images can be reduced without adversely affecting photographic characteristics such as maximum density, sensitivity and gradation.

The present invention is described in greater detail with reference to the following examples. Unless otherwise indicated, all parts, percents, ratios etc. are by weight.

EXAMPLE 1

1. Preparation of Image-Receiving Sheet

On a polyethylene-laminated paper support were provided the layers shown below in the order shown below to form an image-receiving sheet (1). The values in the parentheses are the coated amounts indicated in terms of $g/m^2$.

(1) Neutralizing Layer

Cellulose acetate (degree of acetylation 53%) (6)

Methyl vinyl ether-maleic anhydride copolymer (4)

1-(4-Hexylcarbamoylphenyl)-2,3-dihydroimidazole-2-thione (0.25)

(2) Image Stabilizing Layer

Cellulose acetate (degree of acetylation 45%) (4)

Compound (A) below (2)

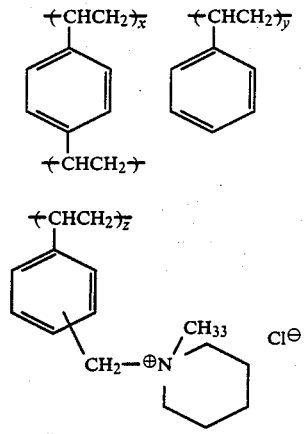

(3) Timing Layer

Cellulose acetate (degree of acetylation 55%) (8)

(4) Image-Receiving Layer

Cellulose acetate (degree of acetylation 55%) (2.0)

Palladium sulfide ($7.5\times10^{-4}$)

Mercaptobenzimidazole ($4\times10^{-3}$)

1-(4-Hexylcarbamoylphenyl) 2,3-dihydroimidazole-2-thione ($1.0\times10^{-2}$)

(5) Saponification

Saponification was conducted from the surface using a mixture of 10.7 g of NaOH, 24 g of glycerine and 280 ml of methanol.

(6) Peeling Layer

Butyl methacrylate-acrylic acid copolymer (molar ratio 15:85) (0.04)

2. Preparation of Light-Sensitive Sheet

On a support (black polyester film) were provided the following layers in the order shown below.

(1) Silver iodobromide having a mean particle size of 0.6 $\mu$m (iodine content 6.1 mol %) (as silver 0.59 $g/m^2$)

Gelatin (4.7)

(2) Protective Layer

Gelatin (0.7)

Polymethyl methacrylate particle (0.1)

3. Preparation of Processing Solution

| | |
|---|---|
| Titanium dioxide | 5 g |
| Potassium hydroxide | 280 g |
| Uracyl | 90 g |
| Tetrahydropyrimidinethione | 0.2 g |
| 1-Phenyl-2-mercaptoimidazole | 0.2 g |
| 2,4-Dimercaptopyrimidine | 0.2 g |
| Zinc oxide | 10 g |
| Triethanolamine | 60 g |
| Hydroxyethyl cellulose | 45 g |
| N,N—bis-methoxyethylhydroxyamine (17% aqueous solution) | 260 g |
| Water | 1,250 ml |

Image-Forming Method:

The light-sensitive sheet was exposed to light through a wedge by the use of a tungsten lamp, and by combining the image-receiving sheet and the processing solution, was developed at 25° C. After 45 seconds or 10 minutes, they were peeled apart.

Forced Image Deterioration Method:

The image pring was stored in a dark place under conditions of 60° C. and 90% RH for 3 days.

Evaluation of Image Storage Properties

Fading:

Density at which the optical density drops to less than 0.5 by forced deterioration at an exposure amount providing an optical density of 0.5 of the image not subjected to the forced deterioration ($\Delta D_{0.5}$).

Discoloration:

Maximum difference in density between the image not subjected to the forced deterioration and the image subjected to the forced deterioration ($\Delta$Dmax).

An image in which the amount of change in $\Delta D_{0.5}$ and $\Delta$Dmax is relatively small can be said to have good storage properties.

If $\Delta$Dmax has a minus value, its discloration is very large.

(I) To the processing solution were added 0.15 mol of the compound shown in Table 1, and depending on the acidity of the compound, the amount of KOH was varied accordingly. Water was added to make the total amount of processing solution to be 2 kg.

TABLE 1

| Compound | 45 Seconds Maximum Density | 45 Seconds Relative Density | 45 Seconds $\Delta D_{0.5}$ | 45 Seconds $\Delta$Dmax | 10 Minutes Maximum Density | 10 Minutes Relative Density | 10 Minutes $\Delta D_{0.5}$ | 10 Minutes $\Delta$Dmax | Remarks |
|---|---|---|---|---|---|---|---|---|---|
| 1 | 1.91 | 101 | 0.05 | 0.10 | 1.95 | 101 | 0.09 | 0.04 | Invention |
| 5 | 1.91 | 101 | 0.07 | 0.11 | 1.95 | 99 | 0.10 | 0.06 | " |
| 7 | 1.90 | 102 | 0.08 | 0.11 | 1.95 | 100 | 0.10 | 0.06 | " |
| 14 | 1.89 | 102 | 0.07 | 0.10 | 1.94 | 101 | 0.11 | 0.02 | " |
| 17 | 1.93 | 98 | 0.06 | 0.09 | 1.96 | 98 | 0.09 | 0.04 | " |
| 20 | 1.94 | 100 | 0.05 | 0.10 | 1.96 | 99 | 0.08 | 0.04 | " |
| Not Added | 1.93 | 100 | 0.10 | 0.14 | 1.95 | 97 | 0.13 | −0.05 | Comparison |
| Ethylenediamine-tetraacetic acid | 2.08 | 101 | 0.11 | 0.13 | 1.95 | 102 | 0.23 | −0.05 | " |
| Nitrilotriacetic acid | 1.88 | 104 | 0.15 | 0.16 | 1.95 | 104 | 0.19 | −0.06 | " |

(II) 2 mmol/m$^2$ of the compound shown in Table 2 were added to the light-sensitive sheet and tested.

TABLE 2

| Compound | 45 Seconds Maximum Density | 45 Seconds Relative Density | 45 Seconds $\Delta D_{0.5}$ | 45 Seconds $\Delta$Dmax | 10 Minutes Maximum Density | 10 Minutes Relative Density | 10 Minutes $\Delta D_{0.5}$ | 10 Minutes $\Delta$Dmax | Remarks |
|---|---|---|---|---|---|---|---|---|---|
| 1 | 1.92 | 101 | 0.09 | 0.12 | 1.95 | 100 | 0.11 | 0.11 | Invention |
| 5 | 1.91 | 101 | 0.09 | 0.14 | 1.95 | 98 | 0.12 | −0.02 | " |
| 7 | 1.92 | 101 | 0.08 | 0.14 | 1.94 | 100 | 0.11 | −0.03 | " |
| 14 | 1.92 | 100 | 0.09 | 0.13 | 1.95 | 100 | 0.12 | −0.03 | " |
| 17 | 1.93 | 100 | 0.08 | 0.12 | 1.95 | 99 | 0.11 | 0.02 | " |
| 20 | 1.93 | 100 | 0.09 | 0.12 | 1.95 | 98 | 0.11 | 0.03 | " |
| Not Added | 1.93 | 100 | 0.10 | 0.14 | 1.95 | 97 | 0.13 | −0.05 | Comparison |
| Ethylenediamine-tetraacetic acid | 1.94 | 100 | 0.11 | 0.14 | 1.95 | 98 | 0.15 | −0.04 | " |
| Nitrilotriacetic acid | 1.92 | 101 | 0.11 | 0.13 | 1.95 | 98 | 0.15 | −0.05 | " |

(III) 20 mmol/m$^2$ of the compound shown in Table 3 were added to the image-receiving sheet and tested.

TABLE 3

| Compound | 45 Seconds Maximum Density | 45 Seconds Relative Density | 45 Seconds $\Delta D_{0.5}$ | 45 Seconds $\Delta$Dmax | 10 Minutes Maximum Density | 10 Minutes Relative Density | 10 Minutes $\Delta D_{0.5}$ | 10 Minutes $\Delta$Dmax | Remarks |
|---|---|---|---|---|---|---|---|---|---|
| 1 | 1.93 | 101 | 0.08 | 0.12 | 1.95 | 100 | 0.10 | 0.03 | Invention |
| 5 | 1.92 | 100 | 0.09 | 0.13 | 1.95 | 100 | 0.11 | −0.02 | " |
| 7 | 1.91 | 100 | 0.09 | 0.13 | 1.95 | 98 | 0.12 | −0.02 | " |
| 14 | 1.93 | 101 | 0.09 | 0.12 | 1.94 | 98 | 0.11 | 0 | " |
| 17 | 1.93 | 100 | 0.08 | 0.12 | 1.95 | 97 | 0.11 | 0.02 | " |
| 20 | 1.92 | 100 | 0.08 | 0.12 | 1.95 | 99 | 0.10 | 0.03 | " |
| Not Added | 1.93 | 100 | 0.10 | 0.14 | 1.95 | 97 | 0.13 | −0.05 | Comparison |
| Ethylenediamine-tetraacetic acid | 1.93 | 100 | 0.12 | 0.15 | 1.95 | 98 | 0.15 | −0.05 | " |
| Nitrilotriacetic acid | 1.92 | 100 | 0.11 | 0.15 | 1.95 | 97 | 0.14 | −0.04 | " |

It can be seen from the above results that the compounds of the present invention improve image storage properties without adversely affecting photographic properties.

While the invention has been described in detail and with reference to specific embodiments thereof, it will be apparent to one skilled in the art that various changes and modifications can be made therein without departing from the spirit and scope thereof.

What is claimed is:

1. A method of forming an image by silver salt diffusion transfer which comprises (a) developing a light-sensitive element including an imagewise exposed light-sensitive silver halide emulsion layer with an alkali processing composition comprising a silver halide solvent to convert at least a portion of unexposed silver halide in the emulsion layer into a transferable silver complex salt, and (b) transferring at least a portion of the silver complex salt to an image-receiving layer containing a silver precipitating agent to form an image on said image-receiving layer, wherein the processing is carried out in the presence of an organic phosphonic acid compound and said organic phosphonic acid compound is contained in said processing solution in an amount of from $5\times10^{-4}$ to 1 mol per kilogram of said processing solution.

2. A method according to claim 1, wherein said organic phosphonic acid compound is selected from the formulas consisting of:

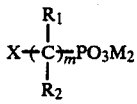

(I)

wherein X is an alkyl group, a substituted alkyl group,

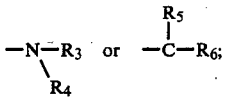

$R_3$, $R_4$, $R_5$ and $R_6$, which may be the same or different, each represents a hydrogen atom or lower alkyl group;

$R_1$ and $R_2$, which may be the same or different, each represents $—PO_3M_2$, —COOM, —OH, $R_7PO_3M_2$, $—R_8(COOM)_n$ or $—R_9OH$, wherein $R_7$, $R_8$ and $R_9$, which may be the same or different, each represents an alkylene group;

m and n each represent an integer from 1 to 3; and M represents H, Na or K,

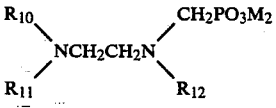

(II)

wherein $R_{10}$, $R_{11}$ and $R_{12}$, which may be the same or different, each represents $—CH_2PO_3M_2$ or $—CH_2COOM$; and M represents H, Na or K, and

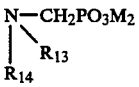

(III)

wherein $R_{13}$ and $R_{14}$, which may be the same or different, each represents $—CH_2PO_3M_2$, $—CH_2COOM$ or a lower alkyl group; and M is H, Na or K.

3. A method according to claim 1, wherein said processing composition comprises a developing agent and a silver halide solvent.

4. A method according to claim 3, wherein said developing agent is present in said composition in an amount of from 0.1 to 40 g per 100 g of said composition.

5. A method according to claim 3, wherein said silver halide solvent is present in said composition in an amount of from 0.1 to 30 g per 100 g of said composition.

6. A method of forming an image by silver salt diffusion transfer which comprises (a) developing a light-sensitive element including an imagewise exposed light-sensitive silver halide emulsion layer with an alkali processing composition comprising a silver halide solvent to convert at least a portion of unexposed silver halide in the emulsion layer into a transferable silver complex salt, and (b) transferring at least a portion of the silver complex salt to an image-receiving layer containing a silver precipitating agent to form an image on said image-receiving layer, wherein the processing is carried out in the presence of an organic phosphonic acid compound and said organic phosphonic acid compound is contained in said image-receiving layer in an amount of from $1\times10^{-5}$ to $5\times10^{-2}$ mol/m$^2$.

7. A method according to claim 6, wherein said organic phosphonic acid compound is selected from the formulas consisting of:

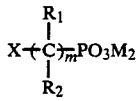

(I)

wherein X is an alkyl group, a substituted alkyl group,

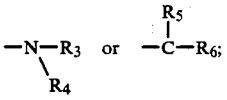

$R_3$, $R_4$, $R_5$ and $R_6$, which may be the same or different, each represents a hydrogen atom or lower alkyl group;

$R_1$ and $R_2$, which may be the same or different, each represents $—PO_3M_2$, —COOM, —OH, $R_7PO_3M_2$, $—R_8(COOM)_n$ or $—R_9OH$, wherein $R_7$, $R_8$ and $R_9$, which may be the same or different, each represents an alkylene group;

m and n each represent an integer from 1 to 3; and M represents H, Na or K,

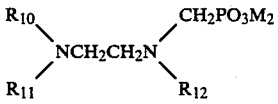

(II)

wherein $R_{10}$, $R_{11}$ and $R_{12}$, which may be same or different, each represents $—CH_2PO_3M_2$ or $—CH_2COOM$; and M represents H, Na or K, and

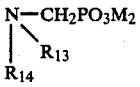

(III)

wherein $R_{13}$ and $R_{14}$, which may be the same or different, each represents $—CH_2PO_3M_2$, $—CH_2COOM$ or a lower alkyl group; and M is H, Na or K.

8. A method according to claim 6, wherein said processing composition comprises a developing agent and a silver halide solvent.

9. A method according to claim 8, wherein said developing agent is present in said composition in an amount of from 0.1 to 40 g per 100 g of said composition.

10. A method according to claim 8, wherein said silver halide solvent is present in said composition in an amount of from 0.1 to 30 g per 100 g of said composition.

11. A method of forming an image by silver salt diffusion transfer which comprises (a) developing a light-sensitive element including an imagewise exposed light-sensitive silver halide emulsion layer with an alkali processing composition comprising a silver halide solvent to convert at least a portion of unexposed silver halide in the emulsion layer into a transferable silver complex salt, and (b) transferring at least a portion of the silver complex salt to an image-receiving layer containing a silver precipitating agent to form an image on said image-receiving layer, wherein the processing is carried out in the presence or an organic phosphonic acid compound selected from the formulas consisting of:

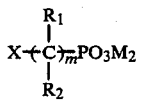

(I)

wherein X is an alkyl group, a substituted alkyl group,

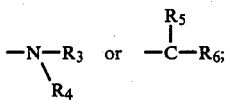

$R_3$, $R_4$, $R_5$ and $R_6$, which may be the same or different, each represents a hydrogen atom or lower alkyl group;

$R_1$ and $R_2$, which may be the same or different, each represents $—PO_3M_2$, —COOM, —OH, $R_7PO_3M_2$, $—R_8(COOM)_n$ or $—R_9OH$, wherein $R_7$, $R_8$ and $R_9$, which may be the same or different, each represents an alkylene group;

m and n each represent an integer from 1 to 3; and M represents H, Na or K,

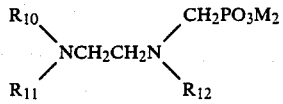

(II)

wherein $R_{10}$, $R_{11}$ and $R_{12}$, which may be same or different, each represents $—CH_2PO_3M_2$ or $—CH_2$-COOM; and M represents H, Na or K, and

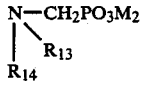

(III)

wherein $R_{13}$ and $R_{14}$, which may be the same or different, each represents $—CH_2PO_3M_2$, $—CH_2$-COOM or a lower alkyl group; and M is H, Na or K.

12. A method according to claim 11, wherein said organic phosphonic acid compound is contained in said light-sensitive layer in an amount of from $2\times10^{-5}$ to $1\times10^{-2}$ mol/m$^2$.

13. A method according to claim 11, wherein said processing composition comprises a developing agent and a silver halide solvent.

14. A method according to claim 13, wherein said developing agent is present in said composition in an amount of from 0.1 to 40 g per 100 g of said composition.

15. A method according to claim 13, wherein said silver halide solvent is present in said composition in an amount of from 0.1 to 30 g per 100 g of said composition.

* * * * *